US010557687B2

(12) United States Patent
Teetzel et al.

(10) Patent No.: US 10,557,687 B2
(45) Date of Patent: Feb. 11, 2020

(54) MODULAR POWERED PLATFORM FOR WEAPON

(71) Applicant: Wilcox Industries Corp., Newington, NH (US)

(72) Inventors: James W. Teetzel, Portsmouth, NH (US); Gary M. Lemire, Lee, NH (US)

(73) Assignee: Wilcox Industries Corp., Newington, NH (US)

( * ) Notice: Subject to any disclaimer, the term of this patent is extended or adjusted under 35 U.S.C. 154(b) by 0 days.

(21) Appl. No.: 15/404,505

(22) Filed: Jan. 12, 2017

(65) Prior Publication Data

US 2017/0205202 A1 Jul. 20, 2017

Related U.S. Application Data

(60) Provisional application No. 62/279,868, filed on Jan. 18, 2016.

(51) Int. Cl.

| | |
|---|---|
| ***F41G 11/00*** | (2006.01) |
| ***F41C 23/16*** | (2006.01) |
| ***F41C 27/00*** | (2006.01) |
| ***F41C 27/06*** | (2006.01) |
| ***F41G 1/34*** | (2006.01) |

(52) U.S. Cl.

CPC ..... *F41G 11/003* (2013.01); *F41C 23/16* (2013.01); *F41C 27/00* (2013.01); *F41C 27/06* (2013.01); *F41G 1/34* (2013.01)

(58) Field of Classification Search

CPC ..... F41G 1/34; F41G 1/35; F41G 1/36; F41G 11/003; F41C 23/16; F41C 27/00; F41C 27/06

USPC ..... 42/71.01–74

See application file for complete search history.

(56) References Cited

U.S. PATENT DOCUMENTS

| | | | | |
|---|---|---|---|---|
| 4,689,911 A * | 9/1987 | White | F41A 19/39 | 42/1.06 |
| 5,555,662 A * | 9/1996 | Teetzel | F41A 9/62 | 356/10 |
| 7,021,187 B1 * | 4/2006 | Grassi | F42B 30/04 | 89/6.5 |

(Continued)

FOREIGN PATENT DOCUMENTS

| | | |
|---|---|---|
| EP | 2653823 A2 | 10/2013 |
| JP | H06111852 A | 4/1994 |
| WO | 2017127298 A1 | 7/2017 |

OTHER PUBLICATIONS

PCT Search Report and Written Opinion received in PCT/US2017/013402.

*Primary Examiner* — Bret Hayes

(74) *Attorney, Agent, or Firm* — McLane Middleton, Professional Association

(57) ABSTRACT

A system for mounting an accessory device on a firearm includes a longitudinally extending handguard affixed to the firearm. The handguard is configured to support the accessory device and includes an upper portion and a lower portion. At least one electrical connector is disposed on each of the upper portion and the lower portion. A power supply is supported on the handguard and circuitry is disposed between the upper portion and the lower portion. The circuitry electrically couples the power supply to the at least one electrical connector disposed on each of the upper portion and the lower portion. In a further aspect, a modular weapon system is provided.

22 Claims, 18 Drawing Sheets

(56) References Cited

U.S. PATENT DOCUMENTS

| | | | | |
|---|---|---|---|---|
| 8,091,265 | B1 | 1/2012 | Teetzel et al. | |
| 8,397,418 | B2 | 3/2013 | Cabahug et al. | |
| 9,062,933 | B1 | 6/2015 | Allen et al. | |
| 9,200,867 | B1 | 12/2015 | Swan | |
| 2006/0191183 | A1 | 8/2006 | Griffin | |
| 2009/0044439 | A1 | 2/2009 | Phillips et al. | |
| 2009/0178325 | A1 | 7/2009 | Veilleux | |
| 2010/0180485 | A1 | 7/2010 | Cabahug et al. | |
| 2013/0036646 | A1* | 2/2013 | Rubac | F41C 23/16 42/90 |
| 2013/0061504 | A1 | 3/2013 | Malherbe et al. | |
| 2013/0104438 | A1 | 5/2013 | Hines | |
| 2014/0059911 | A1 | 3/2014 | Oh et al. | |
| 2014/0150317 | A1 | 6/2014 | Esserman et al. | |
| 2014/0190061 | A1* | 7/2014 | Griffin | F41C 27/06 42/105 |
| 2016/0153744 | A1 | 6/2016 | Teetzel et al. | |
| 2016/0327371 | A1 | 11/2016 | Teetzel et al. | |
| 2019/0249958 | A1 | 8/2019 | Teetzel et al. | |

* cited by examiner

MODULAR POWERED PLATFORM FOR WEAPON

CROSS-REFERENCE TO RELATED APPLICATION

This application claims the priority benefit of U.S. provisional application No. 62/279,868 filed Jan. 18, 2016. The aforementioned application is incorporated herein by reference in its entirety.

INCORPORATION BY REFERENCE

This application is related to U.S. application Ser. No. 15/146,094 filed May 4, 2016, U.S. publication no. 2016/0327371, entitled POWERED ACCESSORY PLATFORM FOR WEAPON, incorporated herein by reference in its entirety, and U.S. nonprovisional application Ser. No. 14/955,363 filed Dec. 1, 2015 now U.S. publication no. 2016/0153744, entitled MODULAR GRENADE LAUNCHER SYSTEM, incorporated herein by reference in its entirety.

BACKGROUND

The present disclosure relates generally to the field of weapon platforms and, more particularly, to a weapon platform with integrated electrical power distribution

SUMMARY

In one aspect, a system for mounting an accessory device on a firearm includes a longitudinally extending handguard affixed to the firearm. The handguard is configured to support the accessory device and includes an upper portion and a lower portion. At least one electrical connector is disposed on each of the upper portion and the lower portion. A power supply is supported on the handguard and circuitry is disposed between the upper portion and the lower portion. The circuitry electrically couples the power supply to the at least one electrical connector disposed on each of the upper portion and the lower portion.

In a more limited aspect, the system includes a vertical handgrip attached to the handguard, wherein the power supply comprises one or more batteries carried within the handgrip.

In another more limited aspect, the system further includes a battery box attached to the handguard, wherein the power supply comprises one or more batteries carried within the battery box.

In another more limited aspect, the one or more batteries includes a first battery and a second battery, the battery box including a switch for selectively coupling a selected one of the first battery and the second battery to the at least one electrical connector disposed on each of the upper portion and the lower portion.

In another more limited aspect, each of the first battery and the second battery is replaceable independently of the other.

In another more limited aspect the at least one electrical connector disposed on each of the upper portion and the lower portion includes two or more conductive rails axially extending along the lower portion.

In another more limited aspect, the system further includes a vertical handgrip slidably attached to the lower portion, wherein said power supply comprises one or more batteries carried within the handgrip. An electrical connector on the handgrip is configured to electrically couple said one or more batteries to the conductive rails at a plurality of axial positions along the lower portion.

In another more limited aspect, the accessory includes a flashlight supported on the lower portion.

In another more limited aspect, the circuitry includes a flexible circuit substrate disposed between the upper portion and the lower portion.

In another more limited aspect, the circuitry is completely enclosed within an enclosure defined by the upper portion and the lower portion.

In another more limited aspect, the system further includes a firearm, wherein the handguard is removably attached to an upper receiver of the firearm in coaxial relation to a barrel of the firearm.

In a further aspect, a modular weapon system comprises a system for mounting an accessory device on a firearm, the system comprising a longitudinally extending handguard affixed to the firearm, the handguard configured to support the accessory device, the handguard including an upper portion and a lower portion. At least one electrical connector is disposed on each of the upper portion and the lower portion. A power supply is supported on the handguard. Circuitry is disposed between the upper portion and the lower portion for electrically coupling the power supply to the at least one electrical connector disposed on each of the upper portion and the lower portion. A lower grenade launcher support platform is configured to be interchangeably attached to the upper portion in place of the lower portion, wherein the upper portion and the lower grenade launcher support platform cooperate with an associated firearm to support a firearm-mounted grenade launcher system.

In a more limited aspect, the modular weapon system further includes an upper grenade launcher support platform configured to be interchangeably attached to the lower grenade launcher support platform in place of the upper portion. The upper grenade launcher support platform and the lower grenade launcher support platform cooperate without the firearm to support a grenade launcher system.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
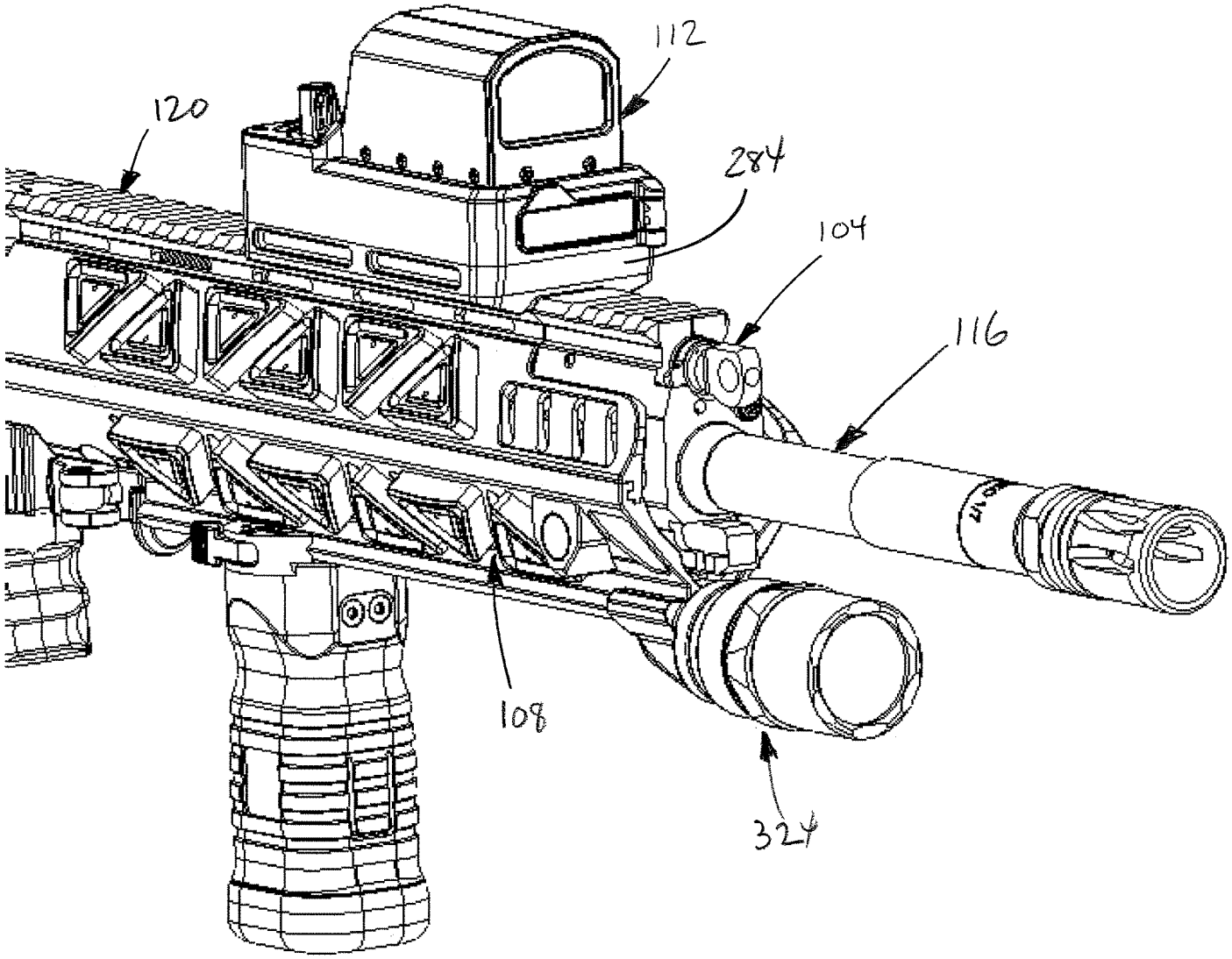
FIG. 1 is an isometric view of a firearm employing an exemplary modular powered weapon platform in a configuration attached to a rifle.
Figure 2:
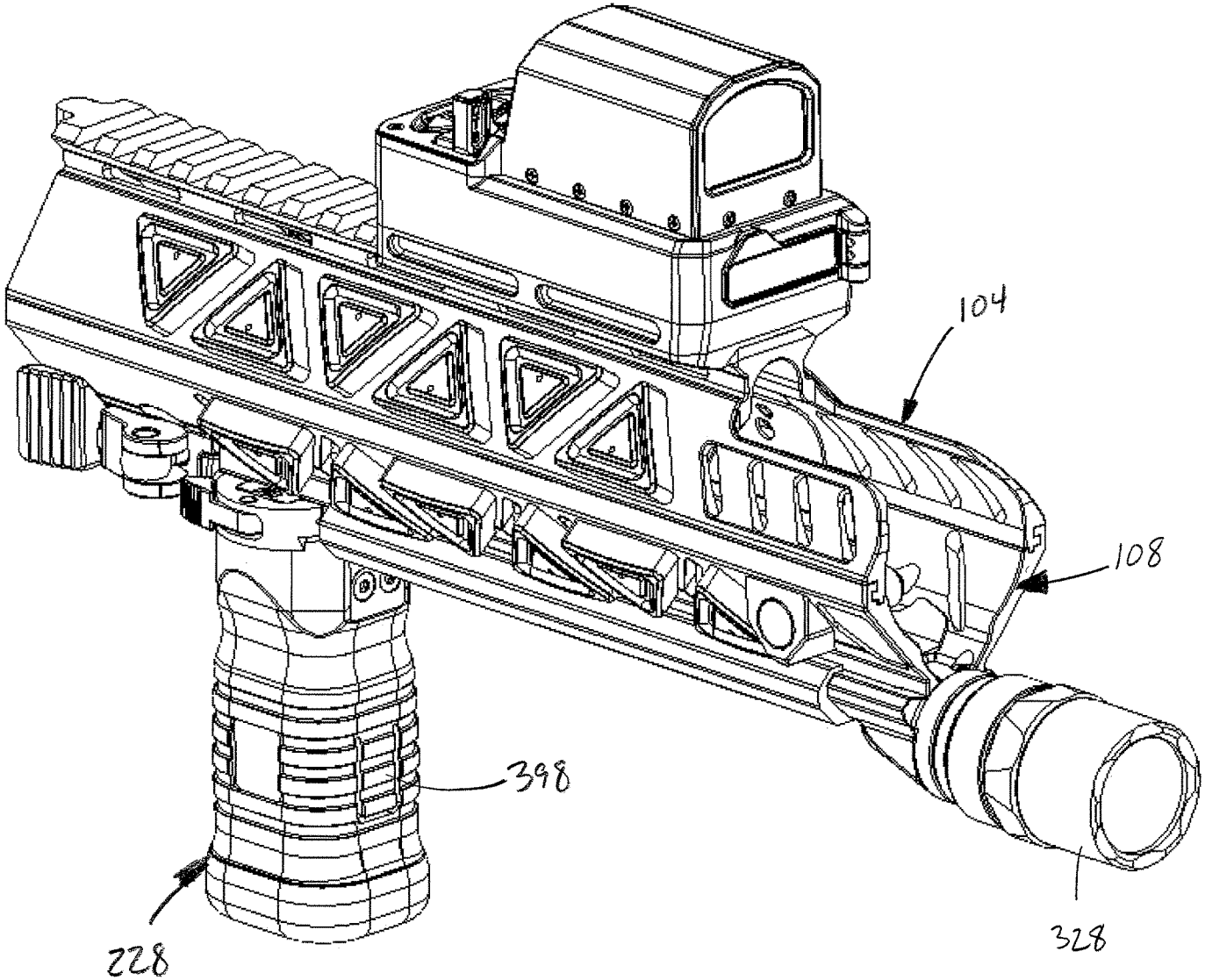
FIG. 2 is an isometric view of the modular powered weapon platform of FIG. 1, with the rifle omitted for ease of exposition.
Figure 3:
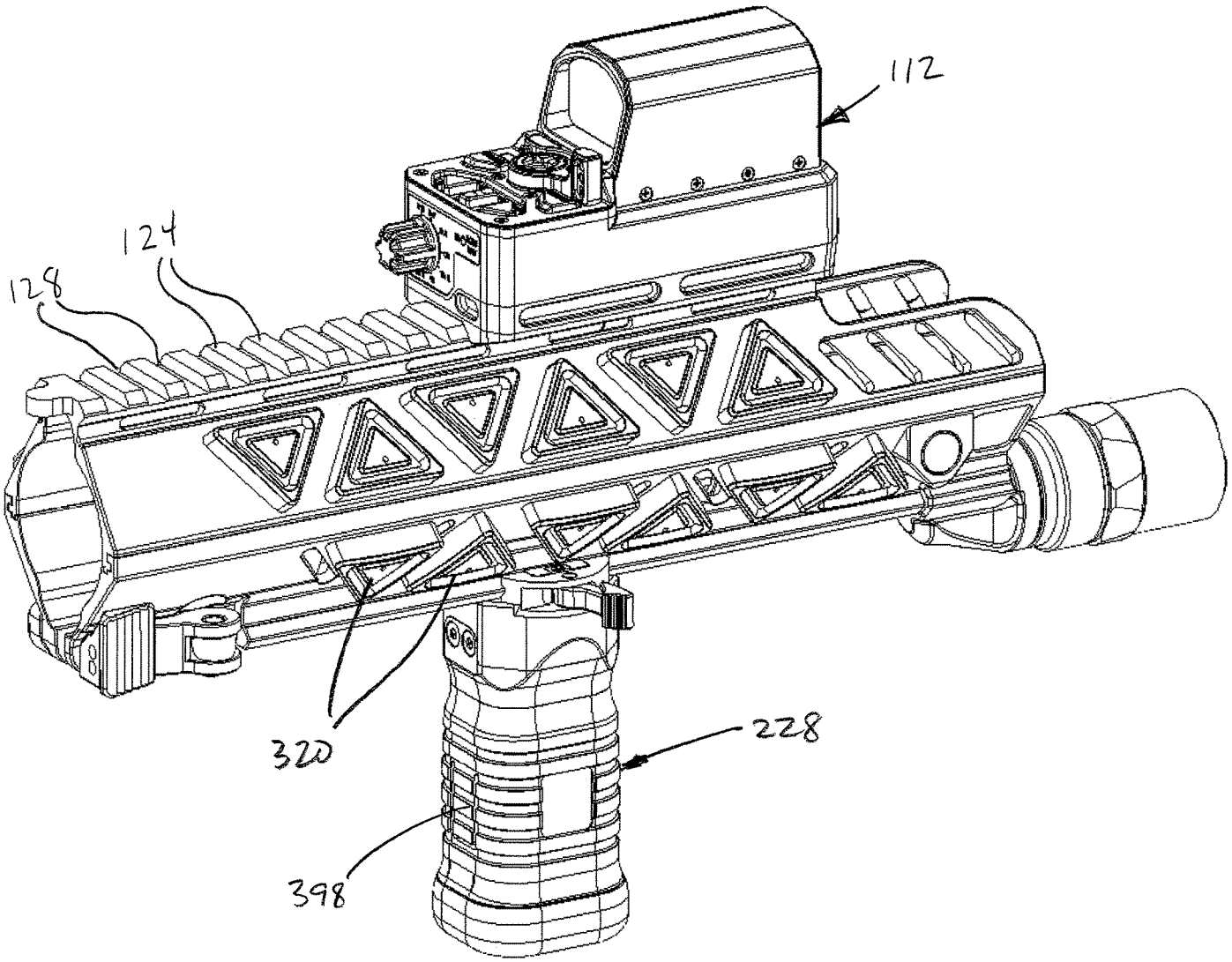
FIG. 3 is an isometric view of the modular powered weapon platform showing the vertical grip lever in the unlocked position for adjusting the axial position of the grip along the slide rail.

Referring now to FIGS. 1-5, a modular powered weapon platform includes a first configuration having a handguard assembly comprising an upper hand guard member 104, a lower handguard member 108, and an electrically operated accessory device 112. The hand guard assembly is configured to attach to a firearm 116 or other weapon. In certain embodiments, the present system is configured to attach to a military or tactical weapon, such as an AR-15, M4 Carbine, M-16, or other like firearms, in place of a conventional accessory rail system, such as a Picatinny rail system (MIL-STD-1913 or NATO equivalent STANAG 4694) that extends around the barrel of the weapon. The upper hand guard member 104 includes an upper accessory rail 120, which may be of a conventional configuration to allow legacy accessory devices to be mounted to the weapon. In the illustrated embodiment, the rail section 120 has a plurality of generally T-cross sectional shaped rail members 124 having recoil grooves 128 therebetween, as is known in the art.

The hand guard assembly upper shell 104 and lower shell 108 cooperate to define an axially extending sleeve defining a channel which is attached to the firearm 116 at or near a first, proximal end 126 and extends distally to surround at least a portion of a barrel of the firearm 116. The upper and lower shells 104, 108, respectively, may be formed of a metal (including metal alloys) and may be formed by casting, extrusion, molding, machining, additive manufacturing, or any combination thereof. In certain embodiments, the hand guard assembly is configured to removably attach to the upper receiver of the firearm using a cam lever fastener to provide clamping attachment to a portion of the upper receiver, e.g., to a barrel nut assembly portion.

Figure 10:
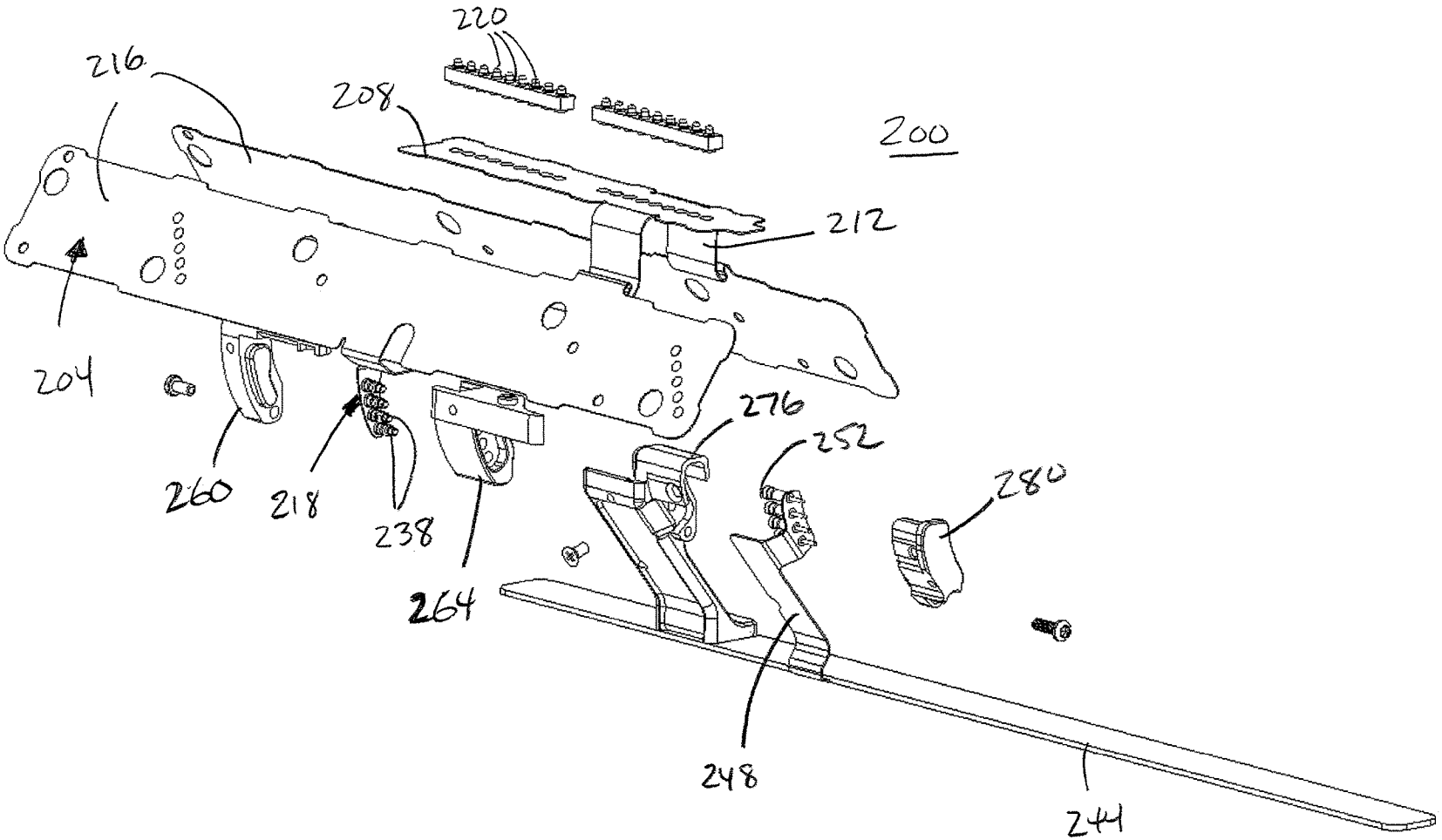
FIG. 10 is an exploded view of the internal circuit components.
Figure 11:
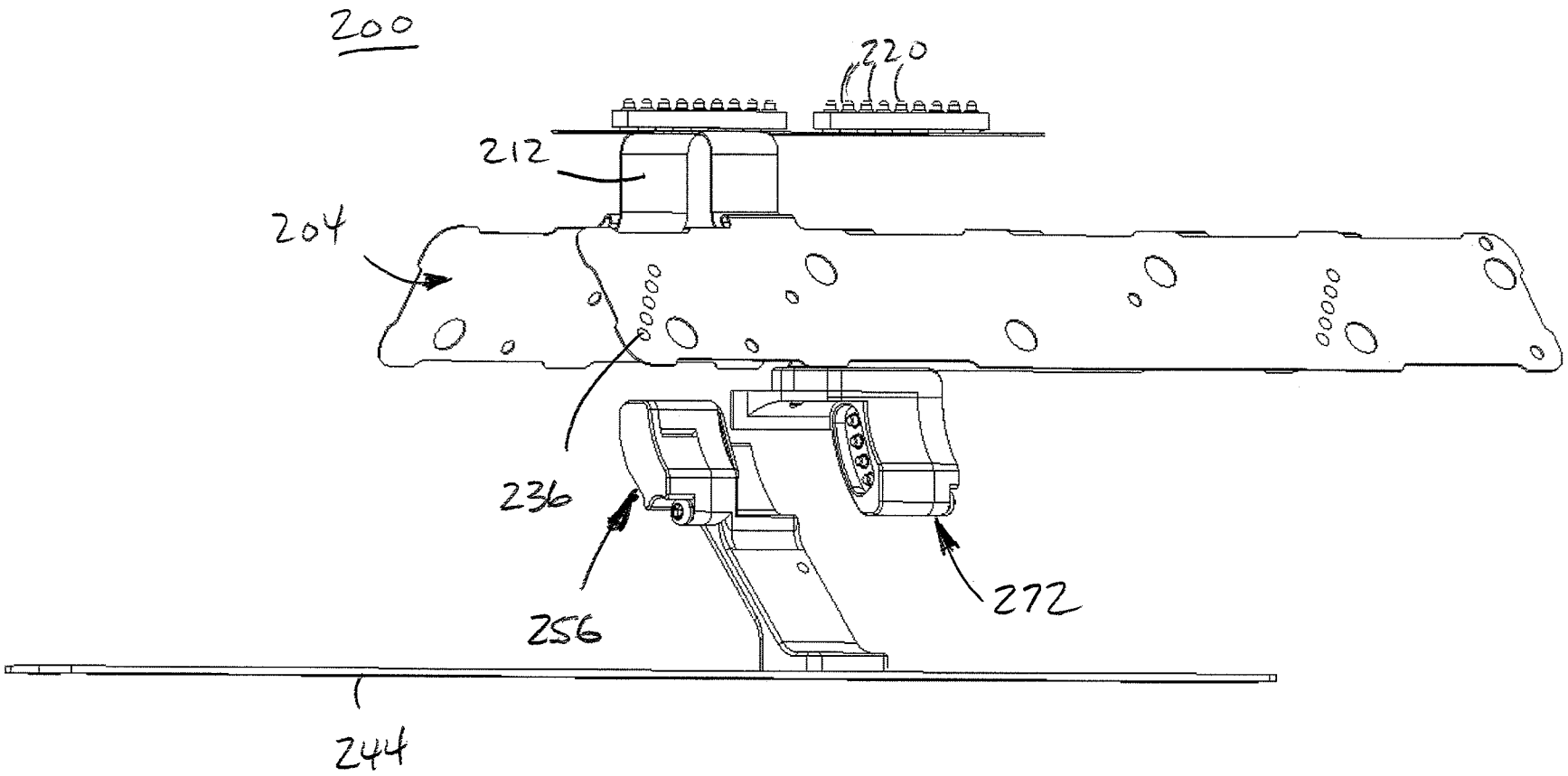
FIG. 11 is an assembly view of the internal circuit components appearing in FIG. 9.
Figure 12:
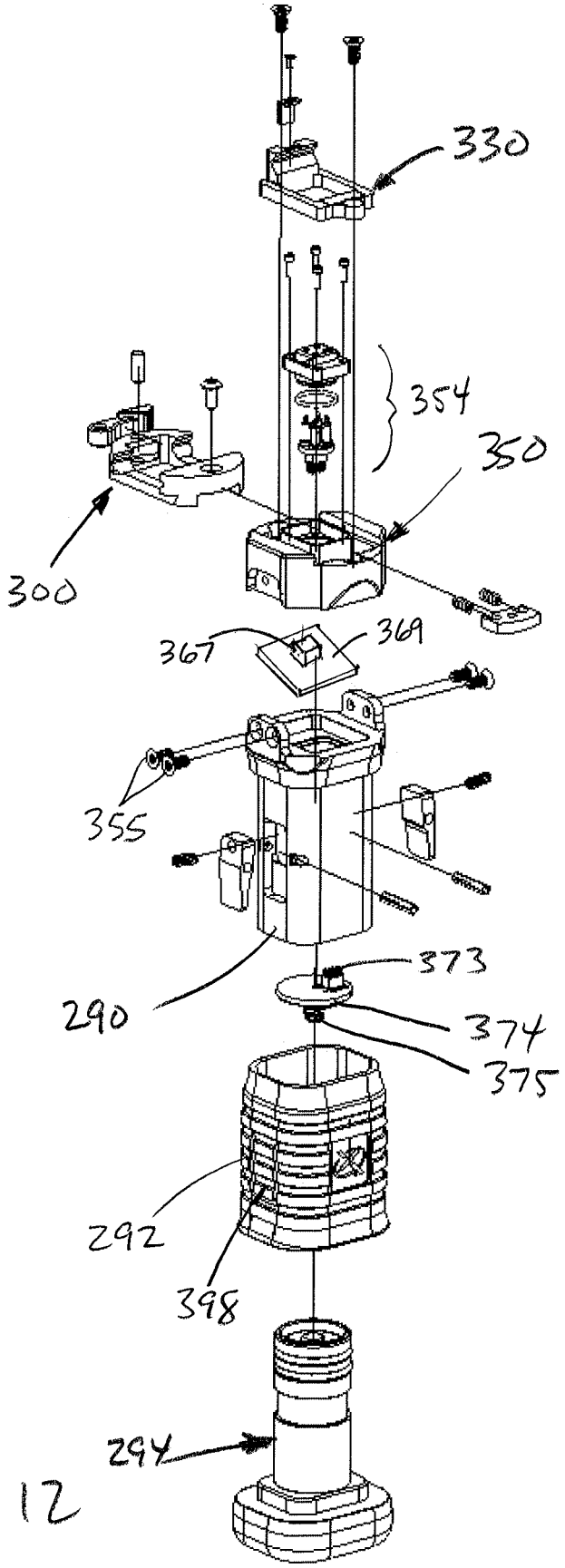
FIGS. 12-15 are exploded views of the grip assembly herein.
Figure 13:
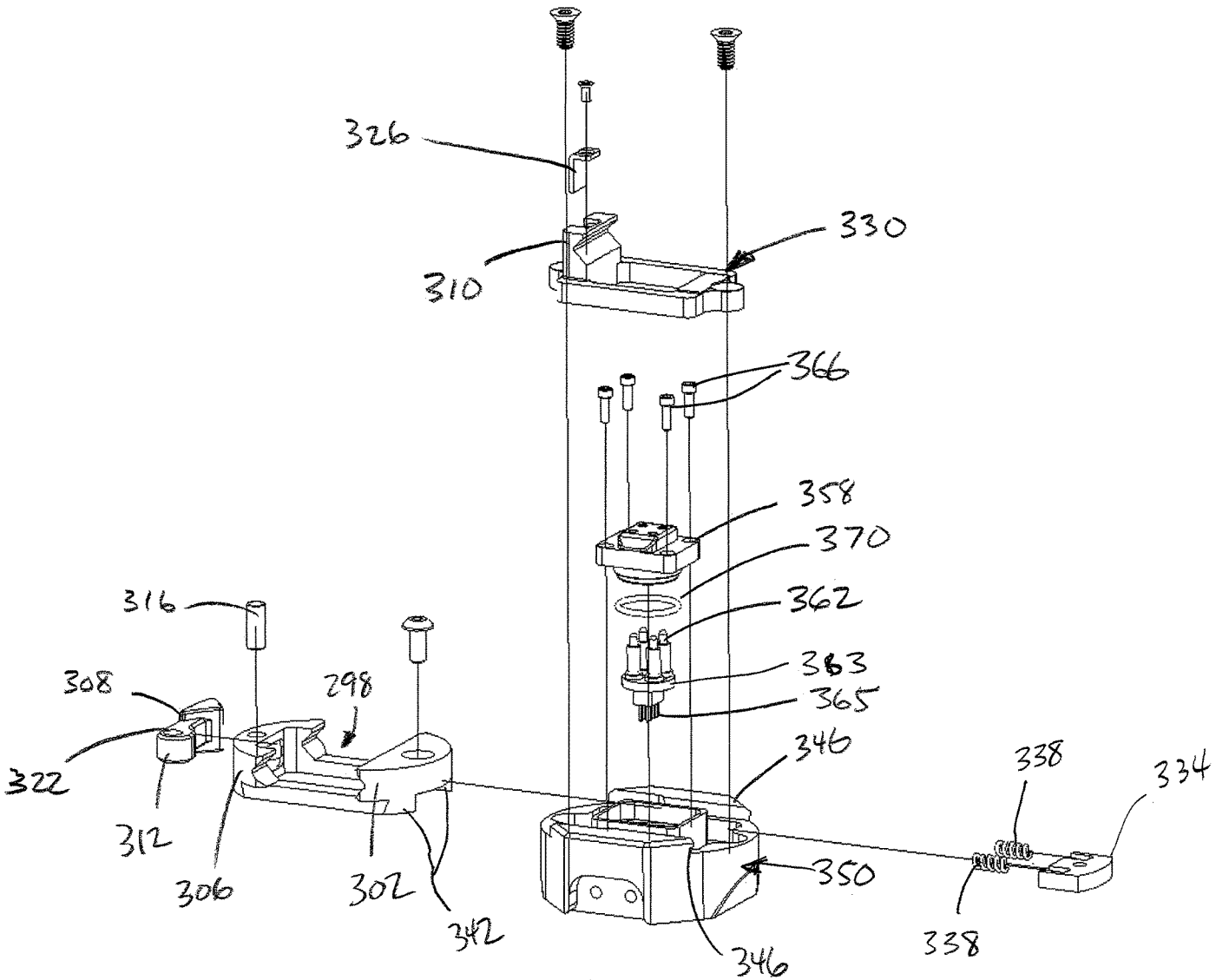
Figure 14:
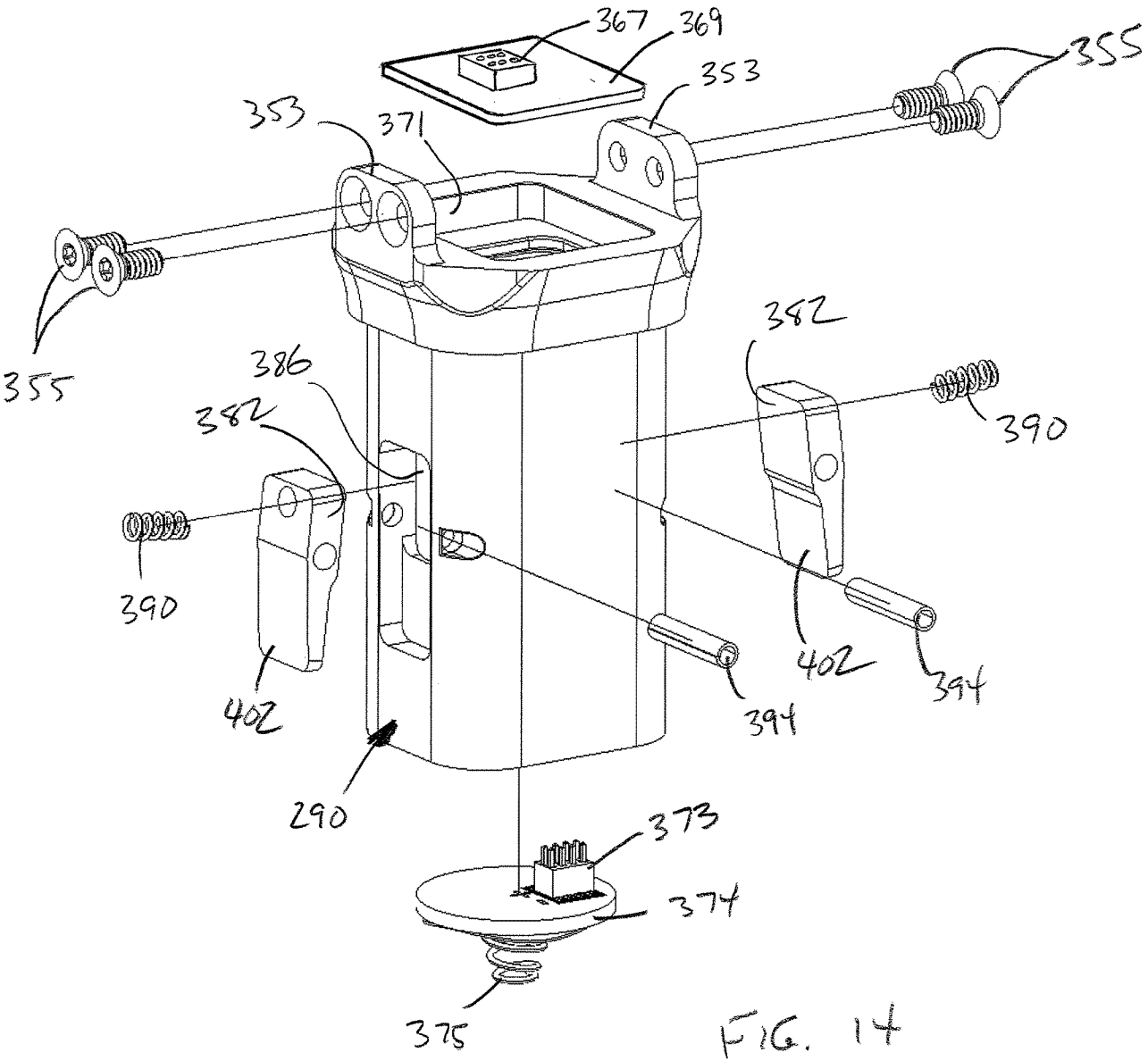
Figure 15:
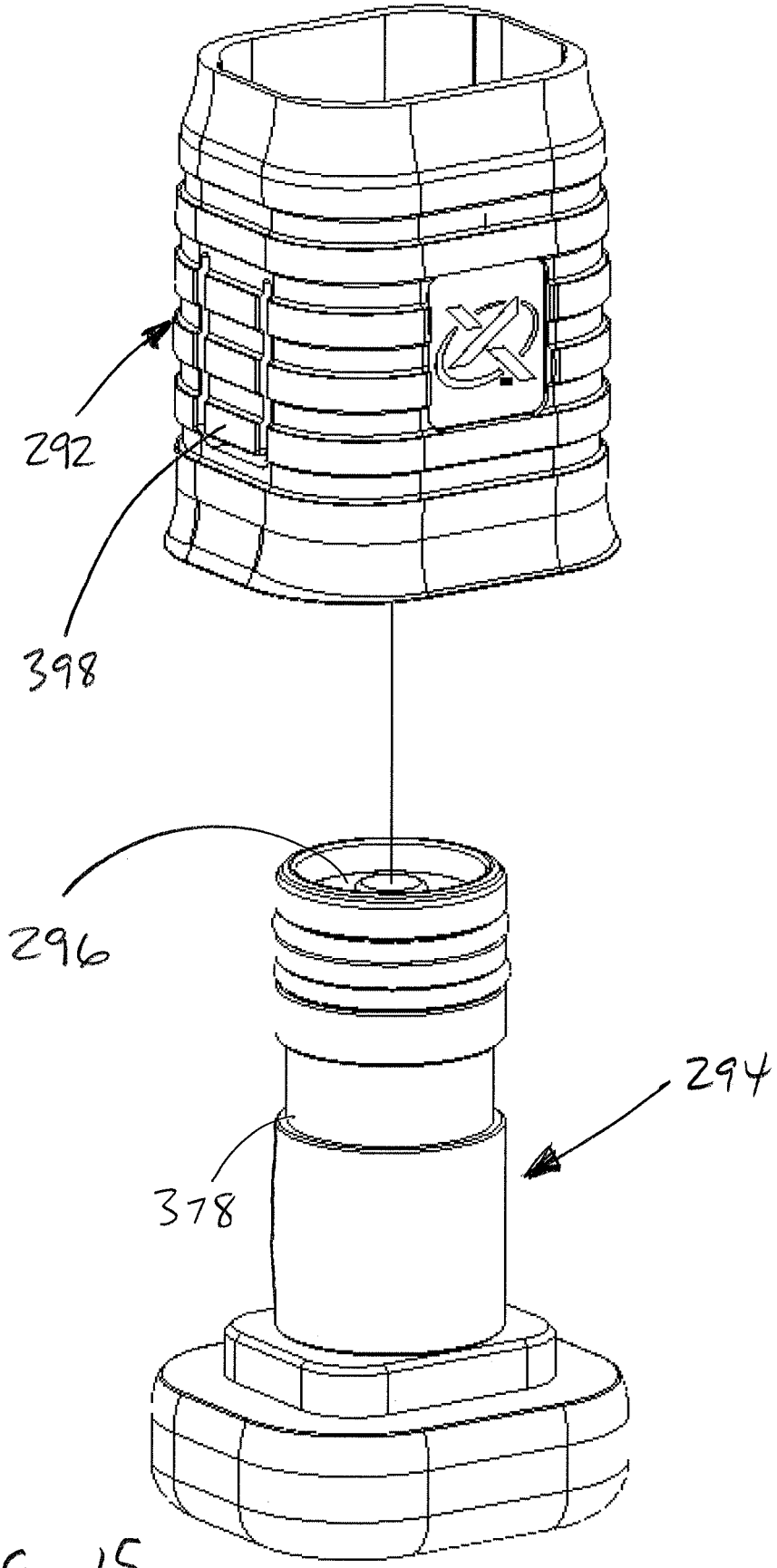
Figure 17:
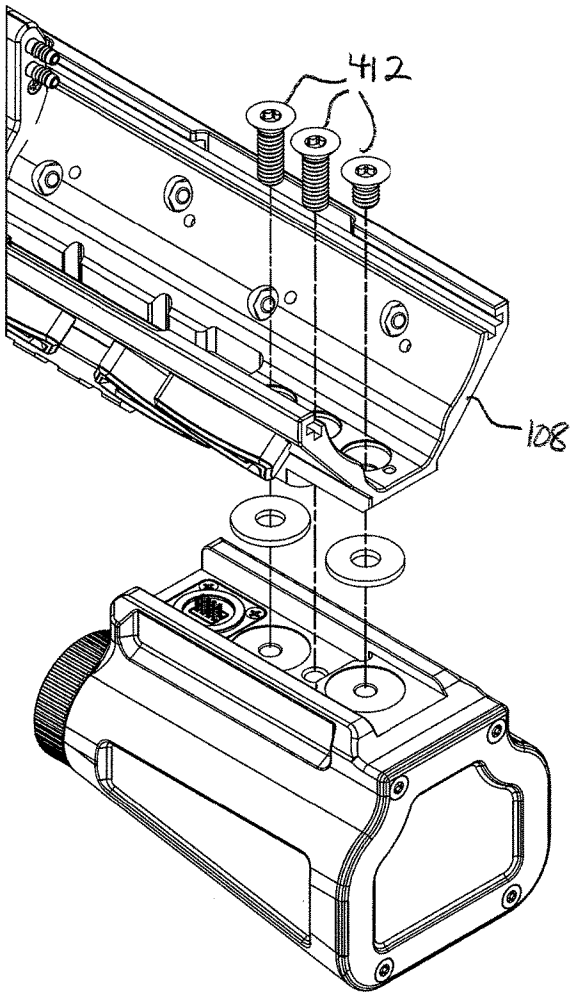
FIG. 17 is a partially exploded view illustrating the manner of attachment of the battery box to the lower handguard.
Figure 16:
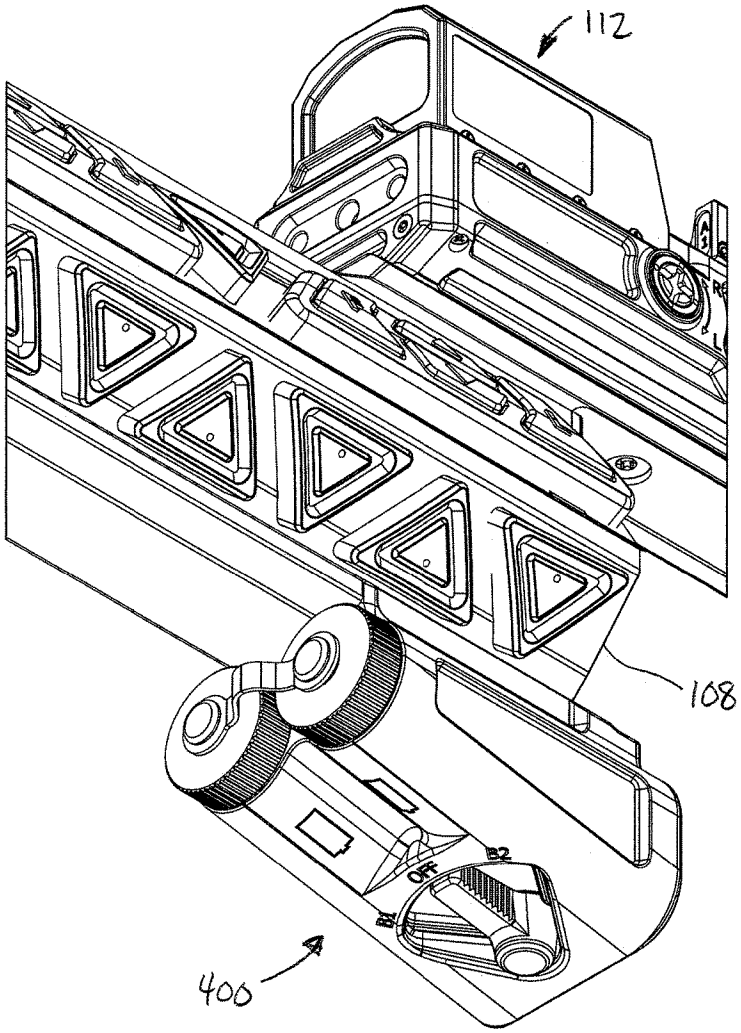
FIG. 16 is an isometric view of a battery compartment attached to a lower handguard portion.
Figure 19:
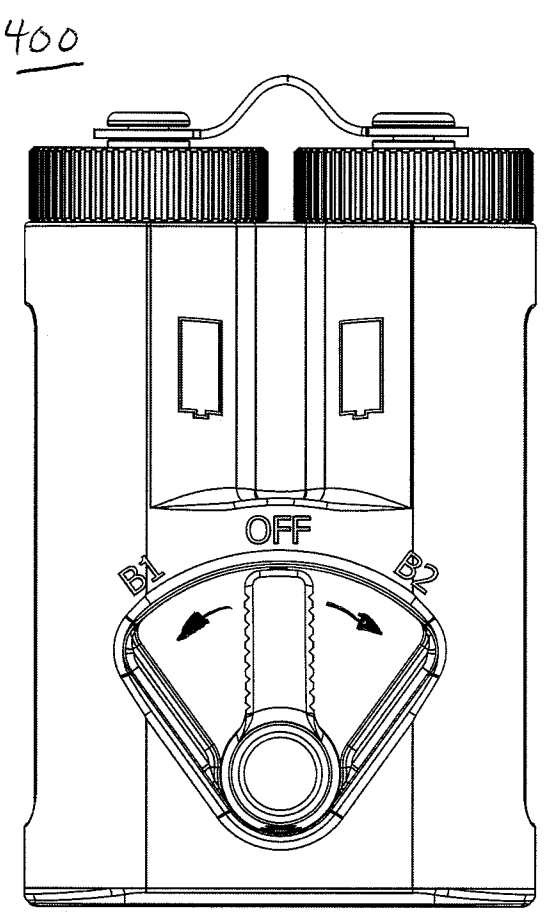
FIG. 19 is a bottom plan view of the battery box.
Figure 18:
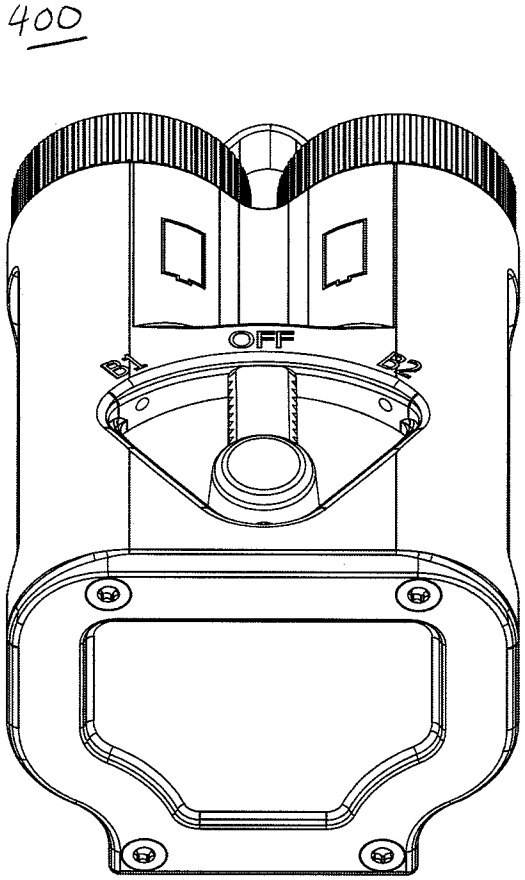
FIG. 18 is a view of the battery box taken from the rear and below.
Figure 20:
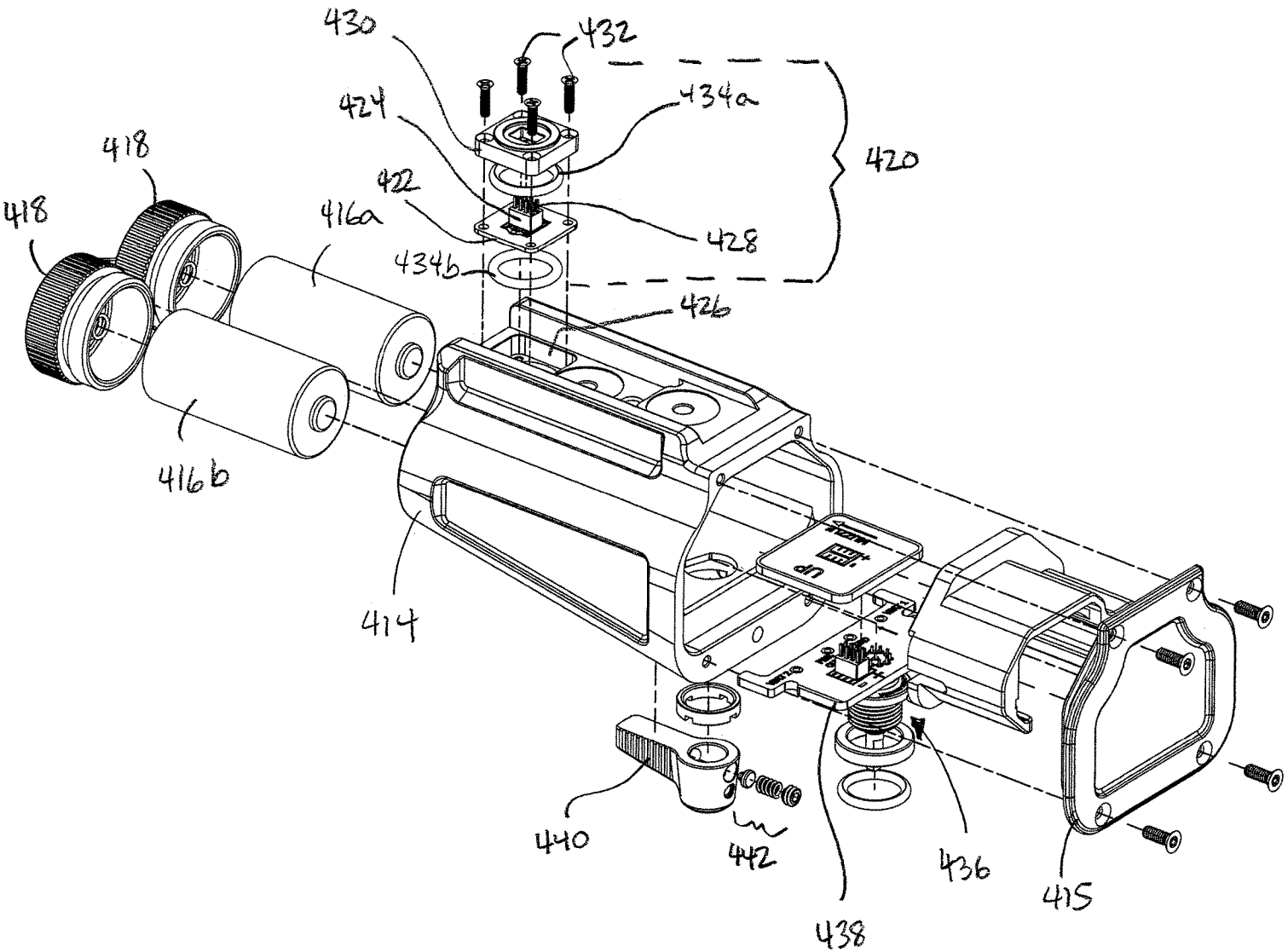
FIG. 20 is an exploded view showing the electrical components of the battery box.

As best seen in FIGS. 10 and 11, and with continued reference to FIGS. 1-5, a flex circuit 200 includes a flexible circuit substrate 204 material such as a polyimide or other suitable flexible film material having printed circuit elements formed thereon. The flex circuit 204 includes a central axially extending portion 208, a pair of transversely extending arms 212 extending therefrom, and a pair of opposing axially extending portions 216. The central portion 208 includes electrical connector elements 220 for electrical connection between an attached accessory device 112 which can be moved to any of a plurality of positions on the rail section 220 and an attached power supply.

In certain embodiments, the power supply comprises one or more batteries or battery packs housed in a vertical handgrip member 228 attached to a slide rail 232 disposed on the lower shell 108. One or both of the axially extending circuit portions 216 may include a plurality of electrical contacts 236 thereon. One of the circuit portions 216 includes an arm 218 having plurality of electrical connector elements 238 thereon. In certain embodiments, the power supply comprises a battery box as described below.

A heat shield (not shown) may be disposed between the barrel of the firearm and the flex circuit 200 to protect the flex circuit and the user's hands from heat buildup in the barrel. The flex circuit 200 may be sandwiched between the heat shield and the shell 104. The heat shield may be formed of aluminum or other thermally conductive material.

The lower shell 108 includes the axial slide rail 232 housing a plurality of axially extending conductive rails 240 (see FIG. 4) on an axially extending circuit board 244. An arm 248 formed of a flexible circuit substrate is attached to the axially extending circuit board 244 and includes a plurality of electrical connector elements 252 which mate with the connector elements 238. The connector elements 238 are housed in a connector housing 256 comprising housing shells 260 and 264 and extend through aligned openings therein. The arm 248 and the connector elements 252 are housed in a connector housing 272 comprising housing shells 276 and 280. The connector elements 252 extend through aligned openings in the housing 272. The housing 256 and the housing 272 mate to electrically couple the plurality of conductive rails 240 in the circuit board 244 with the connector elements 220 via the flex circuit 200.

Figure 4:
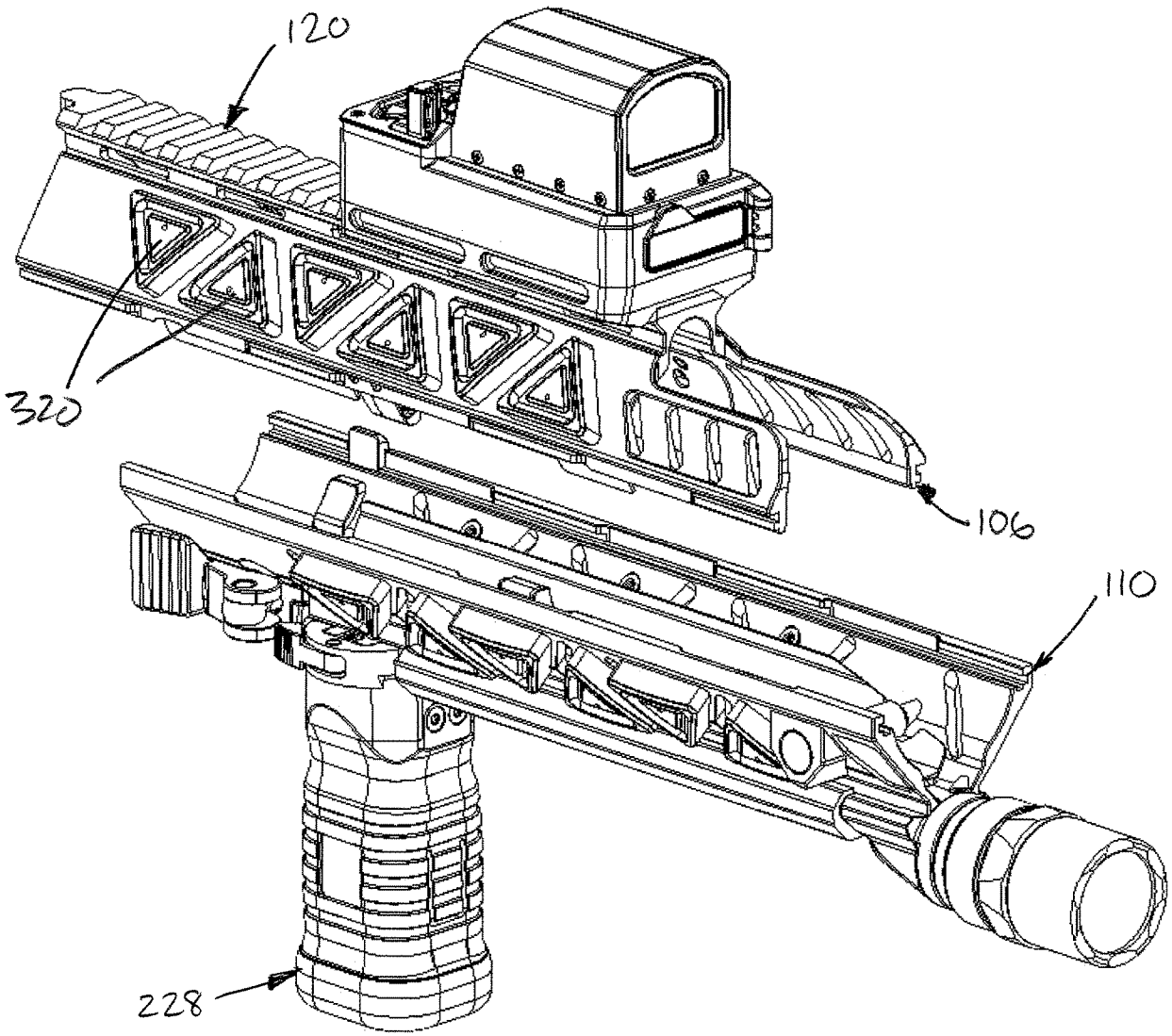
FIG. 4 is a partially exploded view of the modular powered weapon platform appearing in FIG. 1.
Figure 5:
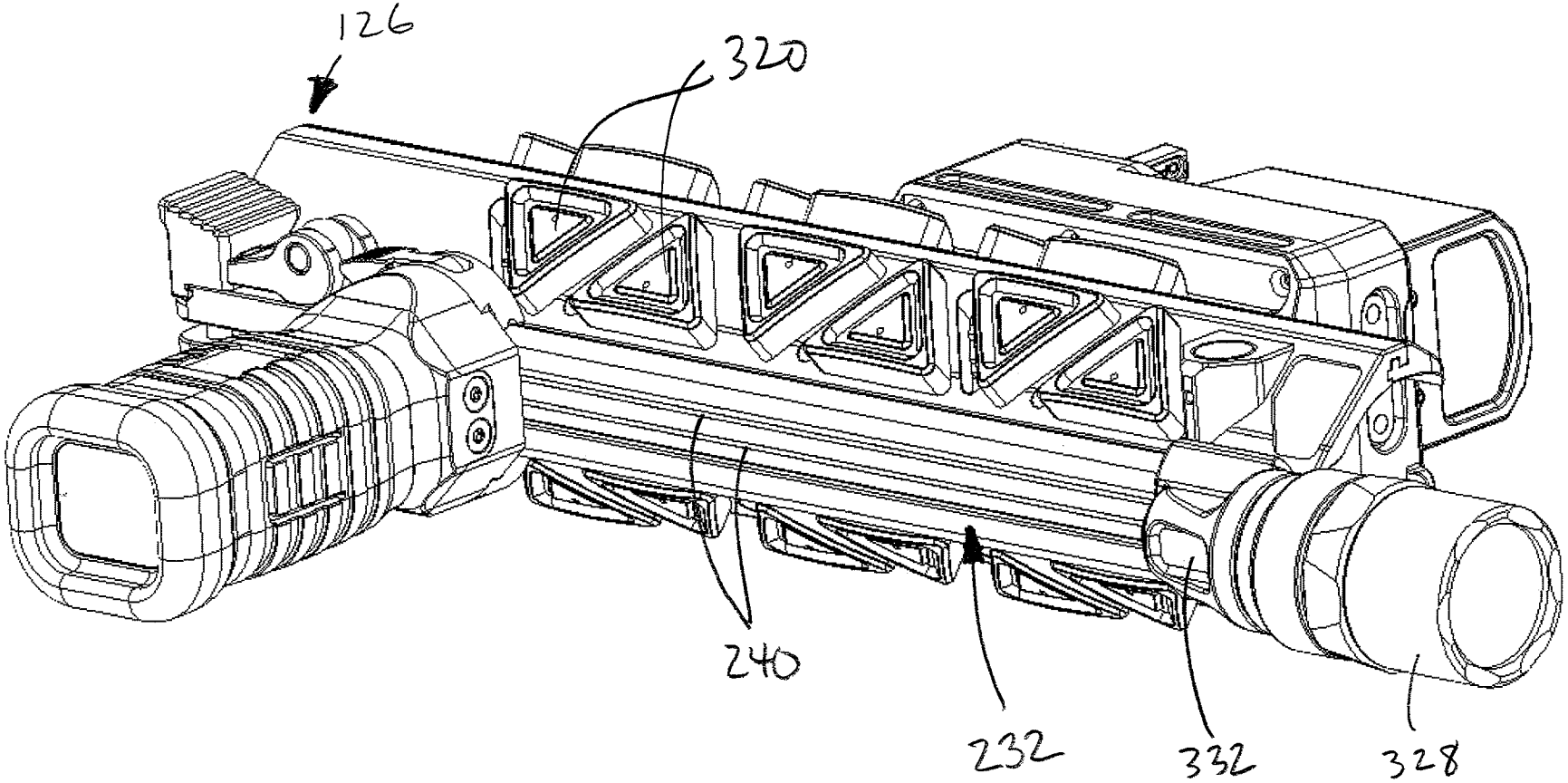
FIG. 5 is an isometric view, taken generally from the bottom, of the modular powered weapon platform appearing in FIG. 1, and illustrating the powered rail.

In certain embodiments, the upper shell 104 and lower shell 108 include complementary, keyed axially extending edges 106, 110, respectively, which may be as detailed in the aforementioned U.S. publication nos. 2016/0327371 and 2016/0153744 and as best seen in FIG. 4. In certain embodiments, the Picatinny-style accessory interface of the upper shell 104 may be replaced with a slide rail and conductive rails as described herein by way of reference to the lower shell 108. In certain embodiments, end closures, sealing rings, gaskets, and the like may be provided to prevent water or other environmental contamination from entering into the enclosure defined by the upper and lower portions 104, 108.

The electrically operated device 112 includes an adapter pad 284 configured to attached to the upper shell 104. The adapter pad 284 includes a first set of electrical connector elements (not shown) which are aligned with the connector elements 220 on the upper shell 104. In the illustrated embodiment, the electrically operated device is a sighting device, such as a reflex sight and/or laser sight. In certain embodiments, the device 112 may be a combined laser/reflex sight, such as that described in commonly owned U.S. application Ser. No. 14/881,779 filed Oct. 13, 2015 (U.S. Publication No. 2016/0102943), which is incorporated herein by reference in its entirety.

Referring now to FIGS. 12-15, and with continued reference to FIGS. 1-5 a handgrip 228 includes an outer housing 292 which may be formed of a material providing good grip adhesion and/or may have a textured surface for enhancing grip disposed over an inner housing 290, which receives a battery compartment 294 which removable from the housing 290 and receiving one or more batteries or battery packs 296.

The upper end of the handgrip 228 includes a rail receptacle 300 defining a channel 298 slidably receiving the slide rail 232. The rail receptacle includes a first, fixed rail grabber 302 shaped to receive a first transverse side of the slide rail 232 and a second rail grabber 306 shaped to receive the second transverse side of the slide rail 232. The second rail grabber 306 includes a movable section 310, which is selectively moved into and out of clamping engagement with the second transverse side of the slide rail 232 using a throw lever 308. The throw lever 308 includes a cam surface 312 at the proximal end thereof bearing against a bearing member 326 on the movable section 310 and pivotally secured to the rail receptacle 300 via a pivot pin 316 defining a pivot axis and engaging an off center opening 322 in the cam lever 308 proximal end. Pivoting the cam lever 308 to the unlocked position (see FIG. 3) allows the user to axially slide the handgrip 228 to a desired axial position on the slide rail 232 and pivoting the cam lever to the locked position serves to selectively clamp the handgrip 228 at a desired axial position on the slide rail 232 while maintaining electrical contact between the conductive rails 240 and connector elements 362 on the handgrip 228. The electrical contacts 362 on the grip assembly 228 thus provide an electrical communication between the power supply 296 and the conductors 240, which, in turn, are in turn in electrical with the electrical connector elements 220 for supplying power to the attached accessory device 112.

The moveable portion 310 of the rail grabber and bearing member 326 are carried on a frame 330 attached to the rail receptacle 300. A stop piece 334 is secured to the rail receptacle 300 and includes springs 338 which bear against the movable portion 310 to urge the movable portion 310 out of engagement with the slide rail 232. When the lever 308 is moved to the locked position (see, e.g., FIG. 2), the cam surface 312 moves the moveable portion 310 toward the rail against the bias of the springs 338.

The rail receptacle 300, in turn, includes male dovetail connector elements 342 which are slidably received within complementary female dovetail receptacles 346 on an end cap 350 attached to the upper end of the handgrip housing shell 290. It will be recognized that other keyed geometrical interlocking cross-sectional shapes, besides dovetail, are also contemplated. The end cap 350 is secured to struts 353 on the upper end of the housing 290 with threaded fasteners 355. An electrical connector 354 comprises a housing 358 and connector elements 362 on a circuit substrate 363. The connector elements 362 are configured to contact the conductors 240 when the handgrip 228 is attached to the slide rail 232 at any axial position of the handgrip 228 along the slide rail 232. The connector 354 is attached to the end cap 350 via threaded fasteners 366. A sealing ring 370 is disposed between the housing 358 and the connector element substrate 363 to prevent entry of moisture or other environmental contamination.

The circuit substrate includes connectors 365 which are electrically connected to a mating connector 367 on a circuit board 369 which is seated in a recess 371 at the upper end of the housing 290. In certain embodiments, the circuit board 369 also carries additional circuitry, such as processing electronics and electronic memory, one or more sensors such as an accelerometer, e.g., a three-axis accelerometer for sensing weapon movement, an RF transceiver such as a Bluetooth, ZigBee, or other wireless communications module, to enable the recording and output of data to an accessory device such as a sight, computer, smartphone, tablet, or other computer-based information handling system.

The circuit board 369 also includes a connector (not shown) electrically coupled to a connector 373 on a circuit board 374, which, in turn is electrically coupled to the one or more batteries 296 via a battery contact 375. The battery compartment 294 includes one or more recesses, such as the annular channel 378 in the depicted embodiment, receiving pivoting retention tabs 382 pivotally secured to the housing 290 and extending through aligned openings 386 therein. Springs 390 captured between the tabs 382 and the interior surface of the outer grip sleeve 292 cause the tabs 382 to pivot inward through the respective openings 386 about respective pivot pins 394 to engage the channel 378 and thereby secure the battery compartment 294 in fixed axial position with respect to the housing 290.

The outer sleeve 292 includes depressible portions 398 aligned with lever portions 402 of the tabs 382 to allow the lever portions 402 to be manually depressed by the user. Manual depression of the levers 402 against the urging of the springs 390 causes the tabs 382 to disengage from the channel 378 and thereby release the battery compartment 294 from the housing 290, e.g., for inserting or replacing the battery(ies) 296.

With continued reference to FIGS. 1-5, in certain embodiments, the upper shell 104 and/or lower shell 108 include insulating pads 320, such as silicone rubber (polysiloxane) pads configured to improve a user's grip and insulate the user's hand from heat generated in the barrel of the firearm, which may be as detailed in the aforementioned U.S. publication nos. 2016/0327371 and 2016/0153744. Optionally, the upper shell 104 and/or lower shell 108 may include one or more keypad buttons as detailed in the aforementioned U.S. publication nos. 2016/0327371 and 2016/0153744 for controlling operation of one or more attached electrical devices. Alternatively or additionally, one or more buttons, switches, or the like, may be provided on the grip 228 for controlling operation of one or more attached electrical devices.

In the illustrated embodiment, a second electrically operated device 324 is a flashlight comprising a flashlight head 328 extending distally from a mounting receptacle 332. The flashlight head may have one or more light emitting elements, preferably LEDs. In certain embodiments, the flashlight head 328 includes one or more LEDs which emit radiation in a visible portion of the electromagnetic spectrum. In other embodiments, the flashlight head 328 includes one or more LEDs which emit radiation in an infrared portion of the electromagnetic spectrum. In still further embodiments, the flashlight head 328 is a dual mode flashlight which includes one or more LEDs which emit radiation in a visible portion of the electromagnetic spectrum and one or more LEDs which emit radiation in an infrared portion of the electromagnetic spectrum.

The mounting receptacle 332 is complementary with the slide rail 232 configured for removable mounting to the distal end of the slide rail 232. The mounting receptacle 332 includes electrical connectors which make contact with the conductors 240 to supply electrical power to the flashlight electrical circuit.

In certain embodiments, it is contemplated that the user may not wish to use the vertical grip 228. In such cases, the grip 228 may be replaced with a dedicated power supply. Alternatively, the grip may be replaced with an electrical connector configured slidably attached to the slide rail 232 and in electrical communication with the conductors 240, wherein a cabled connection may be provided to electrically couple a remote power supply, such as a remote power supply located elsewhere on the weapon (such as being attached to an accessory rail or interface, housed within the buttstock, etc.) or a power supply configured to be worn by the user.

Figure 6:
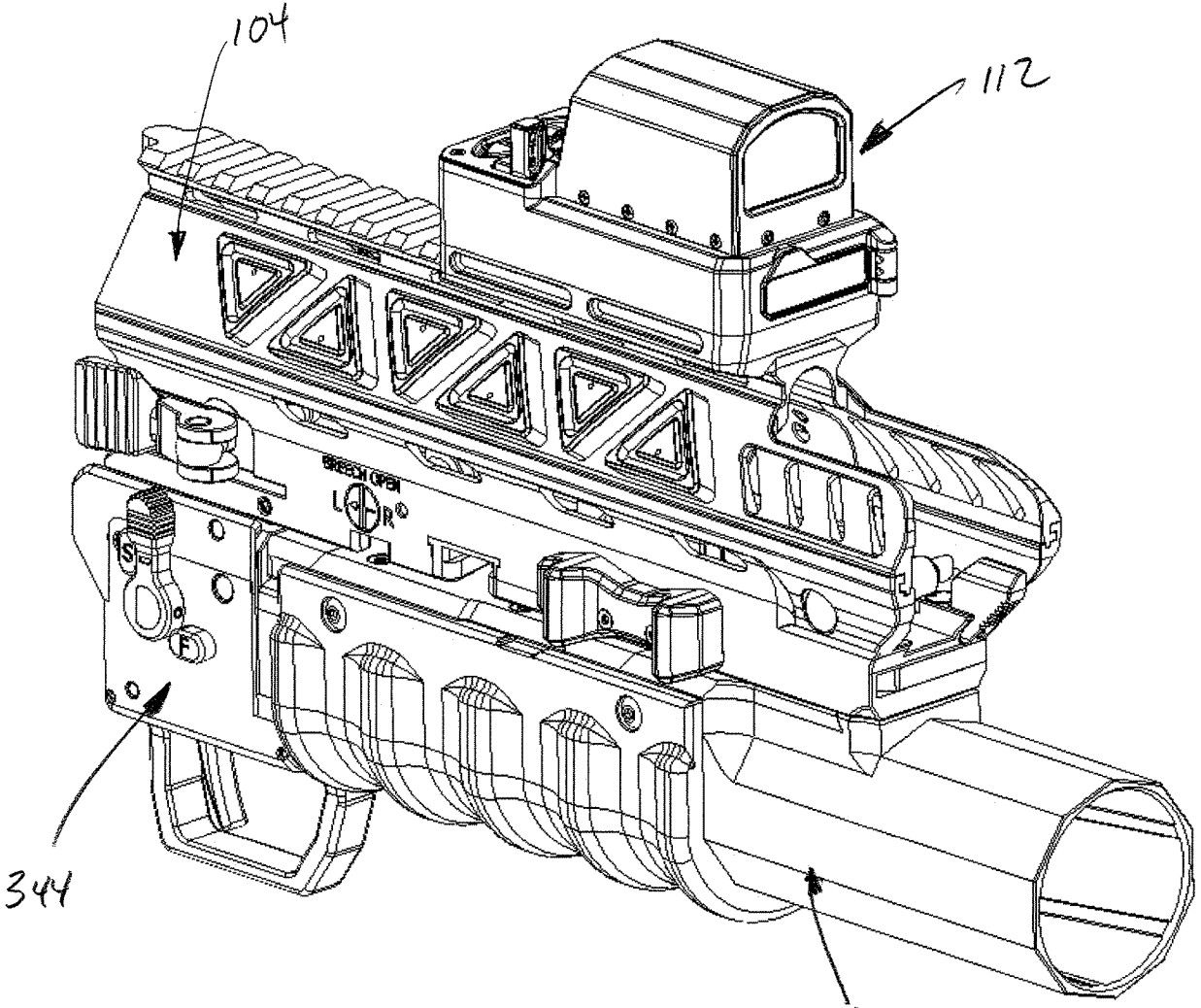
FIG. 6 is an isometric view of the exemplary modular powered weapon platform herein in a grenade launcher configuration adapted to be attached to a firearm (not shown).
Figure 7:
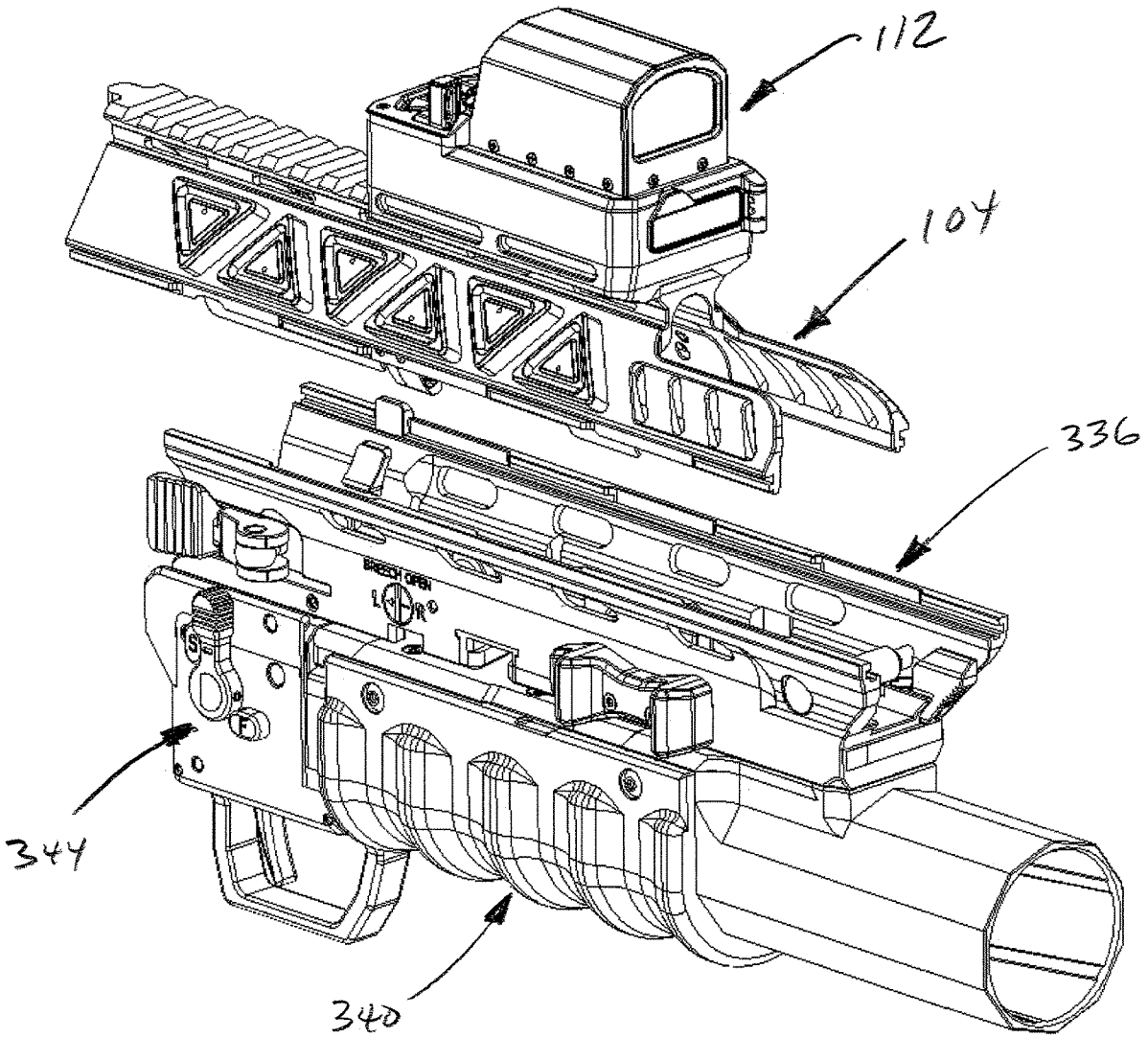
FIG. 7 is a partially exploded view of the grenade launcher configuration appearing in FIG. 5.

Referring now to FIGS. 6 and 7, there appears a second configuration of the powered weapon platform herein. The configuration appearing in FIGS. 6 and 7 includes the upper shell member 104 and accessory device 112 as detailed above, and a lower shell member 336, which may be a grenade launcher support as described in the aforementioned U.S. publication no. 2016/0153744. The members 104 and 336 are configured to secure to a firearm (e.g., via clamping connection to the barrel nut of the firearm), e.g., as described in the aforementioned U.S. publication nos. 2016/0327371 and 2016/0153744. The firearm is omitted in FIGS. 5 and 6 for ease of exposition.

The lower shell member 336, in turn, removably interfaces with a grenade launcher barrel assembly 340 and trigger assembly 344. The mating edge configurations are complementary, e.g., comprising axial sliding tongue and groove features (which may be continuous or, more preferably, segmented) to provide a removable sliding connection therebetween and wherein the upper and lower members 104, 336 are held in place using one more fasteners as described in the aforementioned U.S. publication nos. 2016/0327371 and 2016/0153744.

The grenade launcher barrel assembly 340 and/or trigger assembly 344, in turn, may advantageously be modular components which are interchangeable with one or more alternative barrel assemblies and/or trigger assemblies to accommodate grenades having different calibers and/or designed for different firing platforms, including those described in the aforementioned U.S. publication no. 2016/0153744. The operation and internal construction of the lower shell 336 and the interfacing elements of the grenade launcher barrel assembly 340 and the lower shell member 336 may be as described in the aforementioned U.S. publication no. 2016/0153744.

Figure 8:
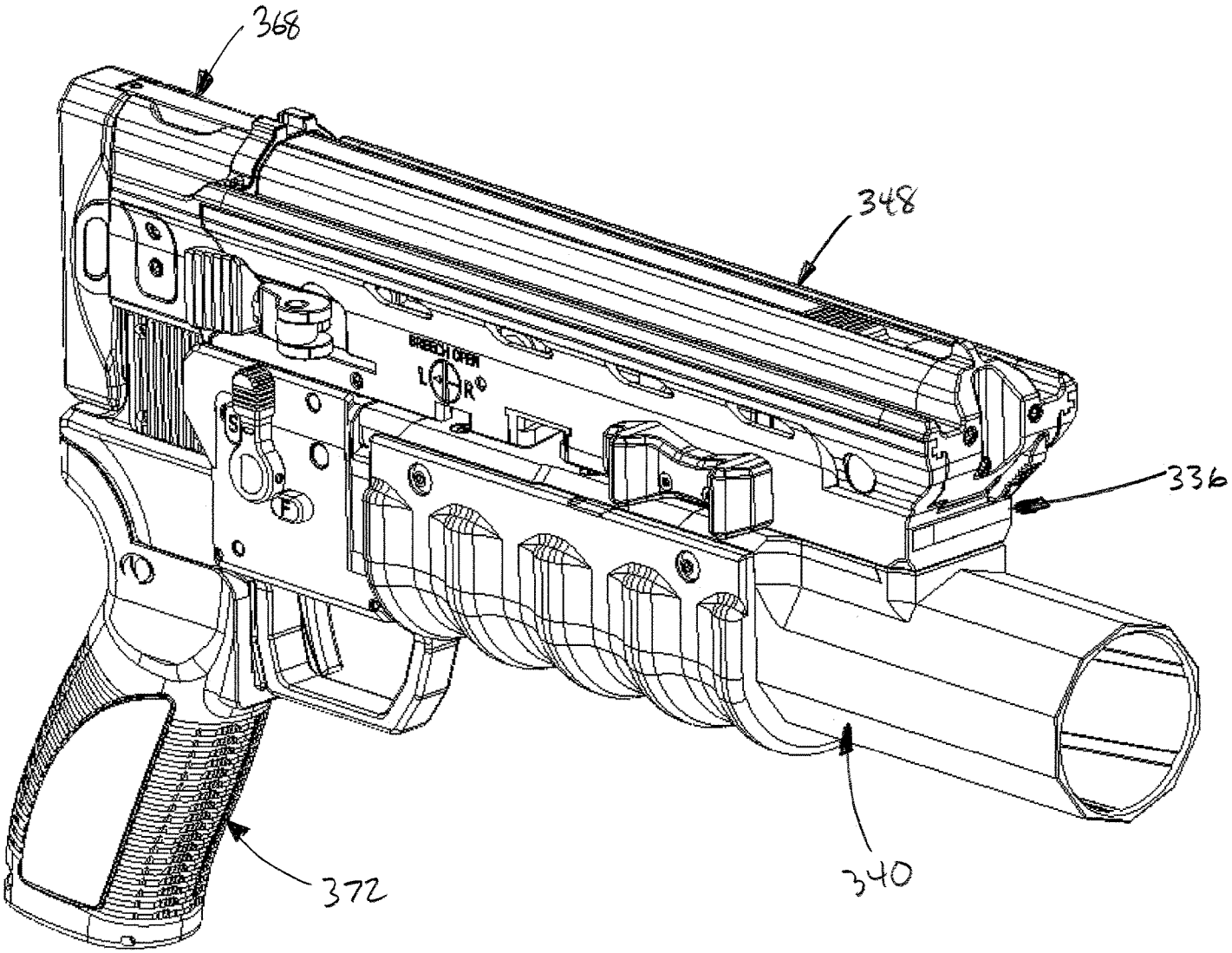
FIG. 8 is an isometric view of the exemplary modular powered weapon platform herein in a stand-alone, hand-held grenade launcher configuration.
Figure 9:
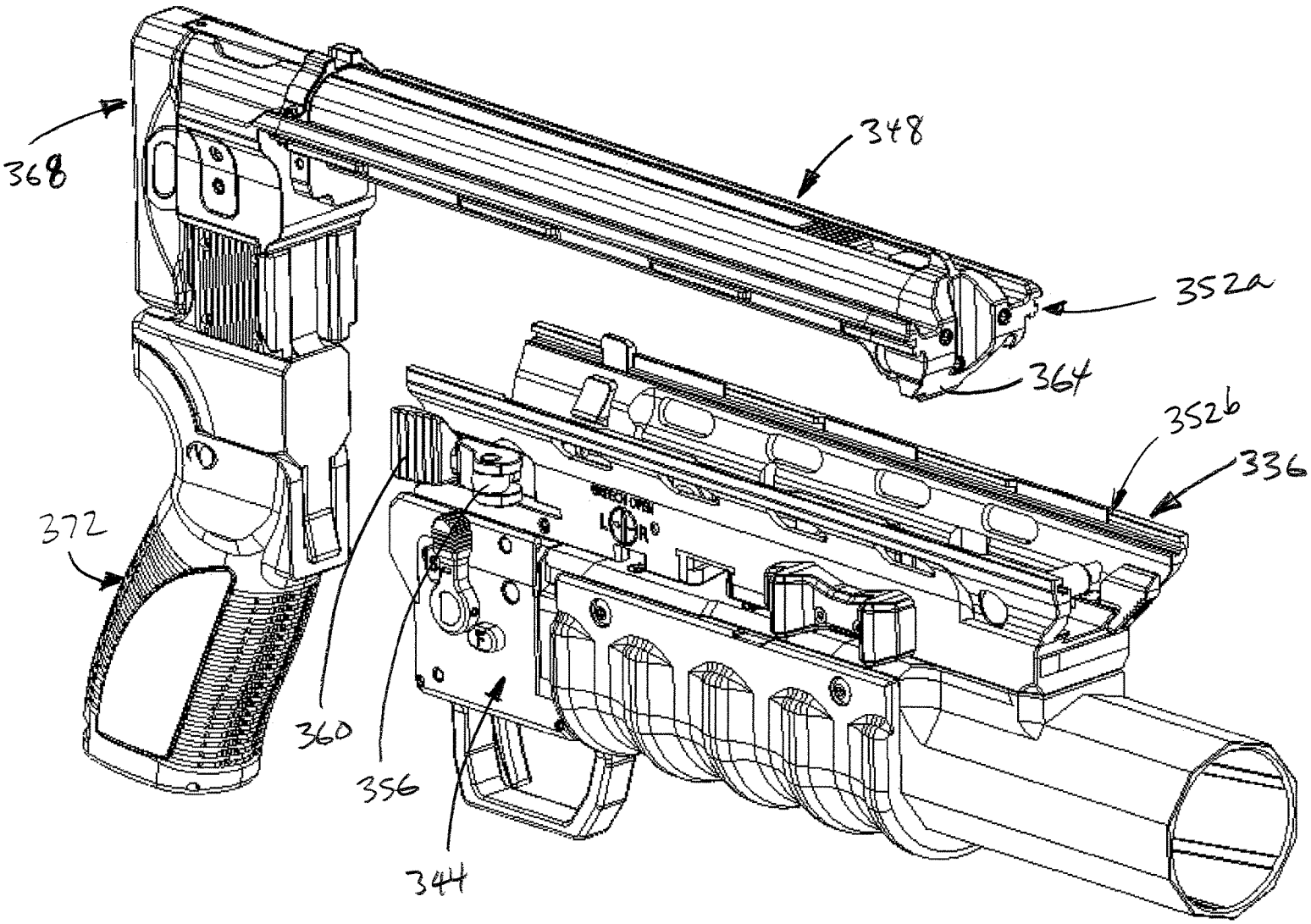
FIG. 9 is a partially exploded view of the stand-alone, hand-held grenade launcher configuration appearing in FIG. 7.

Referring now to FIGS. 8 and 9, there appears a third configuration of the powered weapon platform herein, which provides a standalone, handheld, grenade launcher configuration. The embodiment appearing in FIGS. 8 and 9 includes the grenade launcher barrel assembly 340 and the lower shell member 336, as described above and as further detailed in the aforementioned U.S. publication no. 2016/0153744.

An upper shell 348 is slidably attached to the lower shell member 336 in place of the upper shell 104 via the slidably mating edge interfaces 352*a*, 352*b*, which may form a tongue and groove or other keyed connection and are secured in position via a fastener, such as the drawbar 356 operated by the cam lever 360 as described in the aforementioned U.S. publication no. 2016/0153744. The upper shell 348 includes a distal end member 364 configured to close or cover the distal end of the shells 104, 348, and a proximal end member 368 at the opposite end for removably attaching a pistol grip 372.

The lower shell member 336 is removably attached to the grenade launcher barrel assembly 340 and trigger assembly 344, one or both of which may advantageously be modular components that are interchangeable with one or more alternative barrel assemblies and/or trigger assemblies to accommodate grenades having different calibers and/or designed for different firing platforms, including those described in the aforementioned U.S. publication no. 2016/0153744. Again, the operation and internal construction of the lower shell 336 and the interfacing elements of the grenade launcher barrel assembly 340 and the lower shell member 336 may be as described in the aforementioned U.S. publication no. 2016/0153744.

Referring now to FIGS. 16-20, there appears an exemplary battery compartment 400 operable to provide power via the rail system to one or more attached accessory devices such as the accessory device 112. The battery box 400 includes mounting rails 410 for connection to the lower handguard member 108. The battery compartment may be secured in position via threaded fasteners 412.

The battery box 400 includes a housing 414 with a rear cover 415 which houses two batteries 416*a* and 416*b* within an interior compartment thereof. In certain embodiments, the batteries 416*a*, 416*b* are 3-volt lithium batteries such as CR123 batteries. The housing includes removable covers 418 for providing access to the interior compartment of the housing for inserting or replacing the cells 416. Electrical circuitry within the battery compartment is provided to selectively couple the terminals of the cells to an electrical connector assembly 420.

The electrical connector assembly 420 includes a circuit substrate 422 carrying an electrical connector 424 (e.g., a male multi-pin connector in the illustrated embodiment) which mates with an aligned, complementary connector element within the lower handguard member 108 (e.g., a female multi-pin connector on the circuit board 244). The circuit substrate 422 is received within an opening 426 in the housing 414. The pins 428 extend through an opening in a cover 430, which is secured to the substrate 422 and housing 414 via threaded fasteners 432. Sealing rings or gaskets 434*a* and 434*b* are provided on either side of the substrate 422 to protect against entry of external contamination or moisture into the interior compartment.

The electrical circuitry within the battery compartment includes a switch 436 for selective electrical coupling of a selected one of the batteries 416*a* or 416*b* to the connector 420. In the illustrated embodiment, the switch 436 is a rotary switch on a circuit board 438. The switch 436 includes a lever 440 which is pivotal between position B1 in which battery 416*a* is coupled to the connector 420 and position B2 in which battery 416*b* is coupled to the connector 420, as well as an intermediate "OFF" position in which neither battery is electrically coupled to the connector 420. The lever 440 may include a spring biased detent assembly 442 to provide positive retention in the desired position and resist against inadvertent movement of the lever 440 from the desired position.

In operation, one of the batteries (e.g., battery 416*a* when the lever is in the B1 position) is used to power an accessory device attached to the rail system, such as the device 112, the flashlight device 324, etc. When the battery 416*a* is depleted, the user may manually throw the lever to the other position (e.g., the B2 position) to continue powering the attached device(s). Each battery is individually swappable such that when one cell is depleted it can be changed without affecting operation of the devices being powered.

The invention has been described with reference to the preferred embodiments. Modifications and alterations will occur to others upon a reading and understanding of the preceding detailed description. It is intended that the invention be construed as including all such modifications and alterations insofar as they come within the scope of the appended claims or the equivalents thereof.

What is claimed is:

1. A system for mounting an accessory device on a firearm comprising:

a longitudinally extending handguard affixed to the firearm, the handguard configured to support the accessory device, the handguard including an upper portion and a lower portion;

at least one electrical connector disposed on each of the upper portion and the lower portion;

a power supply supported on the handguard;

circuitry disposed between the upper portion and the lower portion, the circuitry including a flexible circuit substrate, the circuitry electrically coupling the power supply to the at least one electrical connector disposed on each of the upper portion and the lower portion;

a lower grenade launcher support platform configured to be interchangeably attached to the upper portion in place of the lower portion, wherein the upper portion and the lower grenade launcher support platform are configured to cooperate with an associated firearm to support a firearm-mounted grenade launcher system; and an upper grenade launcher support platform configured to be interchangeably attached to the lower grenade launcher support platform in place of the upper portion, wherein the upper grenade launcher support platform and the lower grenade launcher support platform are configured to cooperate, without the firearm, to support a grenade launcher system.

2. The system of claim 1, further comprising a vertical handgrip attached to the handguard, wherein said power supply comprises one or more batteries carried within the handgrip.

3. The system of claim 1, further comprising a battery box attached to the handguard, wherein said power supply comprises one or more batteries carried within the battery box.

4. The system of claim 3, wherein said one or more batteries includes a first battery and a second battery, the battery box including a switch configured to selectively couple a selected one of the first battery and the second battery to the at least one electrical connector disposed on each of the upper portion and the lower portion.

5. The system of claim 4, wherein each of the first battery and second battery is replaceable independently of the other.

6. The system of claim 1, wherein said at least one electrical connector disposed on each of the upper portion and the lower portion includes two or more conductive rails axially extending along the lower portion.

7. The system of claim 6, further comprising:

a vertical handgrip slidably attached to the lower portion, wherein said power supply comprises one or more batteries carried within the handgrip; and an electrical connector on the handgrip configured to electrically couple said one or more batteries to the two or more conductive rails at a plurality of axial positions along the lower portion.

8. The system of claim 1, wherein the accessory includes a flashlight supported on the lower portion.

9. The system of claim 1, wherein the circuitry is enclosed within an enclosure defined by the upper portion and the lower portion.

10. The system of claim 1, further comprising a firearm, wherein the handguard is removably attached to an upper receiver of the firearm in coaxial relation to a barrel of the firearm.

11. The system of claim 1, wherein the upper portion is removably attached to the lower portion.

12. A system for mounting an accessory device on a firearm comprising:

a longitudinally extending handguard affixed to the firearm, the handguard configured to support the accessory device, the handguard including an upper portion and a lower portion;

at least one electrical connector disposed on each of the upper portion and the lower portion;

a power supply supported on the handguard;

circuitry disposed between the upper portion and the lower portion, the circuitry electrically coupling the power supply to the at least one electrical connector disposed on each of the upper portion and the lower portion;

a lower grenade launcher support platform configured to be interchangeably attached to the upper portion in place of the lower portion, wherein the upper portion and the lower grenade launcher support platform are configured to cooperate with an associated firearm to support a firearm-mounted grenade launcher system; and an upper grenade launcher support platform configured to be interchangeably attached to the lower grenade launcher support platform in place of the upper portion, wherein the upper grenade launcher support platform and the lower grenade launcher support platform are configured to cooperate, without the firearm, to support a grenade launcher system.

13. The system of claim 12, further comprising a vertical handgrip attached to the handguard, wherein said power supply comprises one or more batteries carried within the handgrip.

14. The system of claim 12, further comprising a battery box attached to the handguard, wherein said power supply comprises one or more batteries carried within the battery box.

15. The system of claim 14, wherein said one or more batteries includes a first battery and a second battery, the battery box including a switch configured to selectively couple a selected one of the first battery and the second battery to the at least one electrical connector disposed on each of the upper portion and the lower portion.

16. The system of claim 15, wherein each of the first battery and second battery is replaceable independently of the other.

17. The system of claim 12, wherein said at least one electrical connector disposed on each of the upper portion and the lower portion includes two or more conductive rails axially extending along the lower portion.

18. The system of claim 17, further comprising:

a vertical handgrip slidably attached to the lower portion, wherein said power supply comprises one or more batteries carried within the handgrip; and an electrical connector on the handgrip configured to electrically couple said one or more batteries to the two or more conductive rails at a plurality of axial positions along the lower portion.

19. The system of claim 12, wherein the accessory includes a flashlight supported on the lower portion.

20. The system of claim 12, wherein the circuitry is enclosed within an enclosure defined by the upper portion and the lower portion.

21. The system of claim 12, further comprising a firearm, wherein the handguard is removably attached to an upper receiver of the firearm in coaxial relation to a barrel of the firearm.

22. The system of claim 12, wherein the upper portion is removably attached to the lower portion.

* * * * *